US008418863B2

(12) United States Patent
Smerecky et al.

(10) Patent No.: US 8,418,863 B2
(45) Date of Patent: Apr. 16, 2013

(54) RAILCAR COUPLER LOCK WITH CHAMFER ON THE KNUCKLE SHELF SEAT

(75) Inventors: Jerry R. Smerecky, Roselle, IL (US); Thomas A. Marchese, Schaumburg, IL (US); Eric W. Larson, Pecatonica, IL (US)

(73) Assignee: Bedloe Industries LLC, Wilmington, DE (US)

( * ) Notice: Subject to any disclaimer, the term of this patent is extended or adjusted under 35 U.S.C. 154(b) by 0 days.

(21) Appl. No.: 13/548,832

(22) Filed: Jul. 13, 2012

(65) Prior Publication Data

US 2012/0312768 A1 Dec. 13, 2012

Related U.S. Application Data

(63) Continuation of application No. 12/470,883, filed on May 22, 2009.

(60) Provisional application No. 61/055,403, filed on May 22, 2008, provisional application No. 61/055,713, filed on May 23, 2008.

(51) Int. Cl.
*B61G 3/06* (2006.01)

(52) U.S. Cl.
USPC ..... 213/139; 213/151

(58) Field of Classification Search ..... 213/75 R, 213/109, 139, 140, 141, 142, 143, 144, 145, 213/146, 147, 148, 149
See application file for complete search history.

(56) References Cited

U.S. PATENT DOCUMENTS

| | | | | |
|---|---|---|---|---|
| 1,932,440 | A | | 10/1933 | Bazeley |
| 2,688,412 | A | | 9/1954 | Kulieke |
| 2,695,714 | A | | 11/1954 | Kayler |
| 2,909,293 | A | | 10/1959 | Metzger |
| 2,997,755 | A | | 8/1961 | Olson |
| 3,433,369 | A | | 3/1969 | Metzger et al. |
| 3,698,570 | A | | 10/1972 | Metzger |
| 3,767,062 | A | | 10/1973 | Holibaugh |
| 3,850,312 | A | | 11/1974 | Baker, Sr. |
| 3,972,421 | A | | 8/1976 | DePenti |
| 4,084,705 | A | | 4/1978 | Oshinsky et al. |
| 4,090,615 | A | | 5/1978 | Martin |
| 4,143,701 | A | | 3/1979 | Oshinsky et al. |
| 4,363,414 | A | | 12/1982 | Kaim |
| 4,466,546 | A | * | 8/1984 | Altherr et al. ..... 213/148 |
| 5,479,981 | A | | 1/1996 | Kim |

(Continued)

FOREIGN PATENT DOCUMENTS

| | | |
|---|---|---|
| GB | 185657 | 9/1922 |
| GB | 326575 | 3/1930 |

(Continued)

OTHER PUBLICATIONS

International Search Report and Written Opinion for International Patent Application No. PCT/US2010/062574, dated May 30, 2011, 13 pages.

(Continued)

*Primary Examiner* — Mark Le
(74) *Attorney, Agent, or Firm* — Nathan O. Greene; Brinks Hofer Gilson & Lione

(57) ABSTRACT

An improved lock for a railroad coupler, said improvement comprising a chamfer on a knuckle shelf seat.

7 Claims, 9 Drawing Sheets

U.S. PATENT DOCUMENTS

| | | | |
|---|---|---|---|
| 5,878,897 | A | 3/1999 | Lazzaro et al. |
| 6,588,490 | B2 | 7/2003 | Rommel et al. |
| 7,302,994 | B2 | 12/2007 | Mautino et al. |
| 2002/0007931 | A1 | 1/2002 | Crafton et al. |
| 2005/0184021 | A1 | 8/2005 | Mautino et al. |
| 2009/0289024 | A1 | 11/2009 | Nibouar et al. |

FOREIGN PATENT DOCUMENTS

| | | | |
|---|---|---|---|
| GB | 2292899 | A | 3/1996 |
| GB | 2300611 | A | 11/1996 |
| JP | 101402131 | A | 4/2009 |
| WO | WO2009142748 | A1 | 11/2009 |
| WO | WO2009142750 | A1 | 11/2009 |
| WO | WO2009142757 | A1 | 11/2009 |

OTHER PUBLICATIONS

Office Action with English translation for Chinese Patent Application No. 200980123771.7, dated Sep. 24, 2012, 11 pages.

* cited by examiner

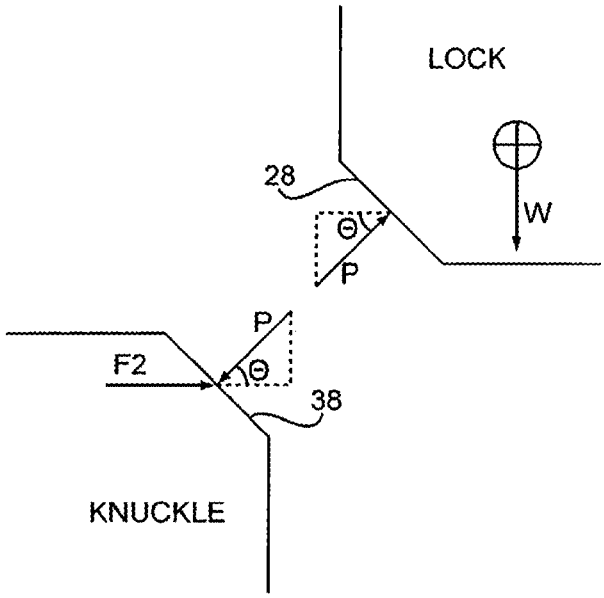

Fig. 8

Calculations showing the reduction in force required to open the knuckle due to the increase chamfer:

F1 α F2 (F1 is proportional to F2)

$$\cos\Theta = \frac{F2}{P}$$

$$F2 = P\cos\Theta$$

$$\sin\Theta = \frac{W}{P}$$

$$W = P\sin\Theta$$

$$\frac{F2}{W} = \frac{P\cos\Theta}{P\sin\Theta}$$

$$\frac{F2}{W} = \frac{1}{\tan\Theta}$$

$$F2 = \frac{W}{\tan\Theta}$$

As $\Theta \rightarrow 0°$, $\tan\Theta \rightarrow 0$, $F2 \rightarrow \infty$, since F1 α F2, $F1 \rightarrow \infty$ As $\Theta \rightarrow 90°$, $\tan\Theta \rightarrow \infty$, $F2 \rightarrow 0$, since F1 α F2, $F1 \rightarrow 0$

Fig. 9

RAILCAR COUPLER LOCK WITH CHAMFER ON THE KNUCKLE SHELF SEAT

RELATED APPLICATIONS

This application claims priority to U.S. application Ser. No. 12/470,883, filed May 22, 2009, which claims priority to U.S. Provisional Application No. 61/055,713, filed May 23, 2008, and U.S. Provisional Application No. 61/055,403, filed May 22, 2008, the disclosures of which are incorporated herein by this reference in their entireties.

TECHNICAL FIELD

The present disclosure relates generally to the field of railroad couplers, and more specifically to an improved coupler lock which improves knuckle rotation from lock set with a chamfer on the knuckle shelf seat.

BACKGROUND

Railcar coupler locks typically have three positions: locked, unlocked and lock set. The lock set position allows couplers to be released when the railcars are pulled apart. Coupler assemblies sometimes do not operate properly in lock set, with the knuckle of the coupler jammed against the lock, preventing proper knuckle rotation. In some cases, knuckle and lock interference occurs in lock set. This requires the user to lift and hold the uncoupling lever in its most raised position to facilitate uncoupling, rather than lifting the handle to position the lock into lockset and remaining in that position so the operator can let go of the uncoupling lever. Holding the uncoupling lever in the raised position to ensure the coupler is unlocked while cars are being coupled or uncoupled can be a safety concern and is not recommended. When addressing lock set jamming concerns between the knuckle and lock, the traditional focus to resolve the problem was on the lock and its interface with the thrower.

The options can be limiting if the focus is just on the components in previous patents, such as U.S. Pat. Nos. 2,350,470; 2,709,007; 3,850,312; 4,084,705 and 4,363,414, all of which are herein incorporated by reference in their entirety. The options are also limiting when the focus is only on the mating parts of the system.

Other disadvantages may have also included the inability to completely measure (scan) to a very accurate level (+/−0.001") all the surfaces of each component (either theoretically or from actual production parts), to create a very accurate CAD model (+/−0.001") of each part, and then create a working CAD assembly of the system. Furthermore, the designer may not have the ability to use that model to investigate the issues, and to model and then simulate the proposed design changes to optimize the model. In the past, it is surmised that the companies with the design engineering capabilities were either not interested in, unable to undertake the time, devote the engineering resources, and/or spend the money necessary to investigate the concerns to the detail necessary to identify the concern, and then design a fix to these concerns. Modern day computer software and hardware are now available (at an attainable cost) and provide the tools necessary so that those that are experts in the field can use these tools to address these issues that were here-to-for left unaddressed.

There is a need to improve knuckle rotation to eliminate jamming while in lock set without delineating significantly from the accepted coupler assembly.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like-referenced numerals designate corresponding parts throughout the different views.

FIG. 8 is a schematic view of the circled area in FIGS. 6 and 7.

FIG. 9 is an equation detailing the reduction in force required to open in the knuckle due to the present invention.

SUMMARY

In a first embodiment, an improved lock for a railroad coupler is provided comprising a chamfer on a knuckle shelf seat.

In a second embodiment, an improved lock for a railroad coupler is provided comprising a variable radius fillet on the knuckle shelf seat of said lock.

In a third embodiment, an improved lock for a railroad coupler includes at least one modification that results in lowering the force to open the knuckle or reduce or eliminate the occurrence of knuckle jamming.

DETAILED DESCRIPTION

Figure 1:
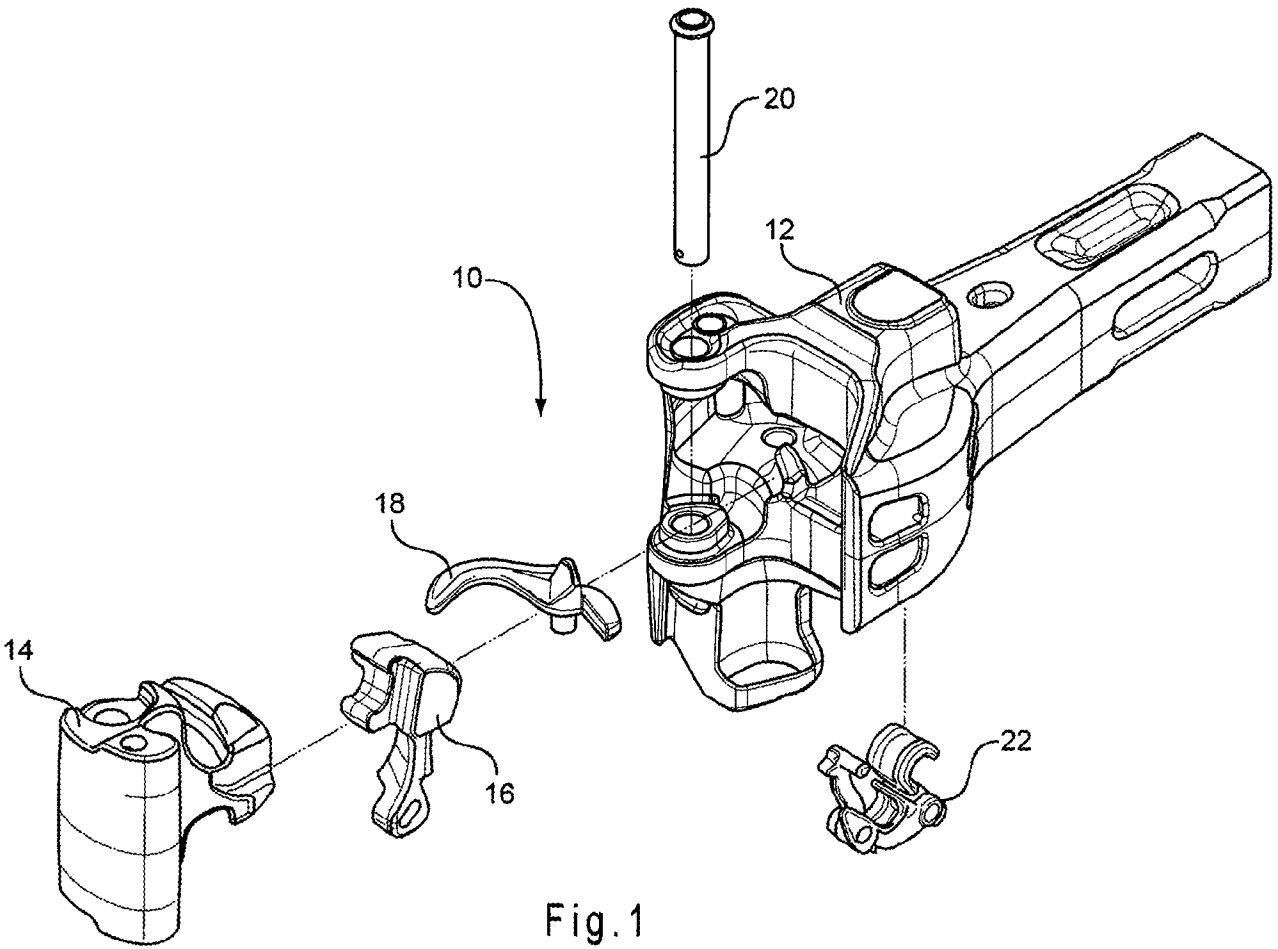
FIG. 1 is a perspective view of an exploded railroad coupler.
Figure 2:
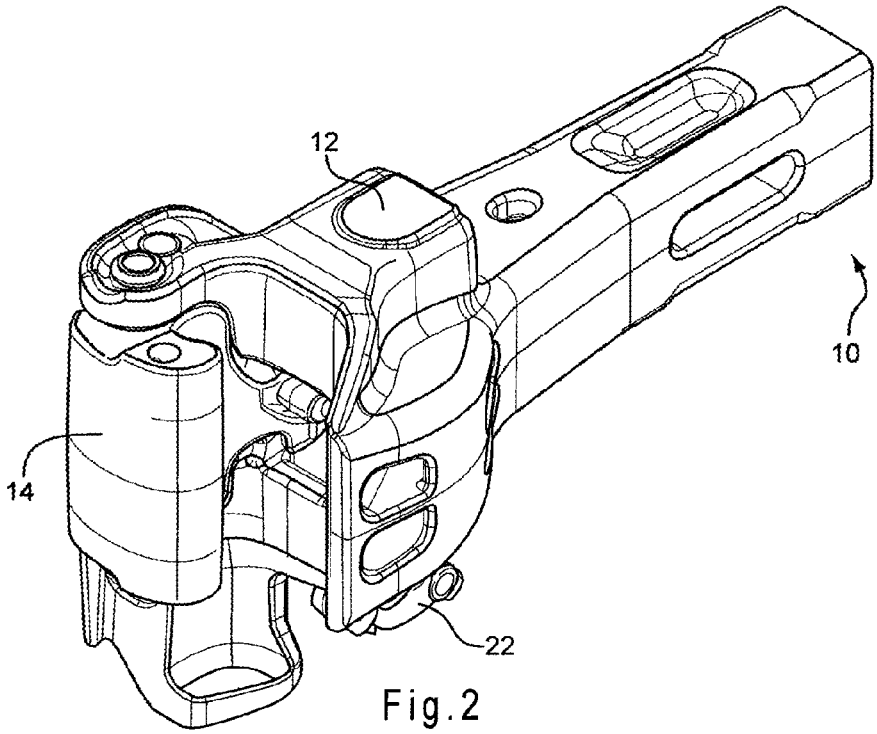
FIG. 2 is a perspective view of the coupler of FIG. 1 in an assembled configuration.
Figure 3A:
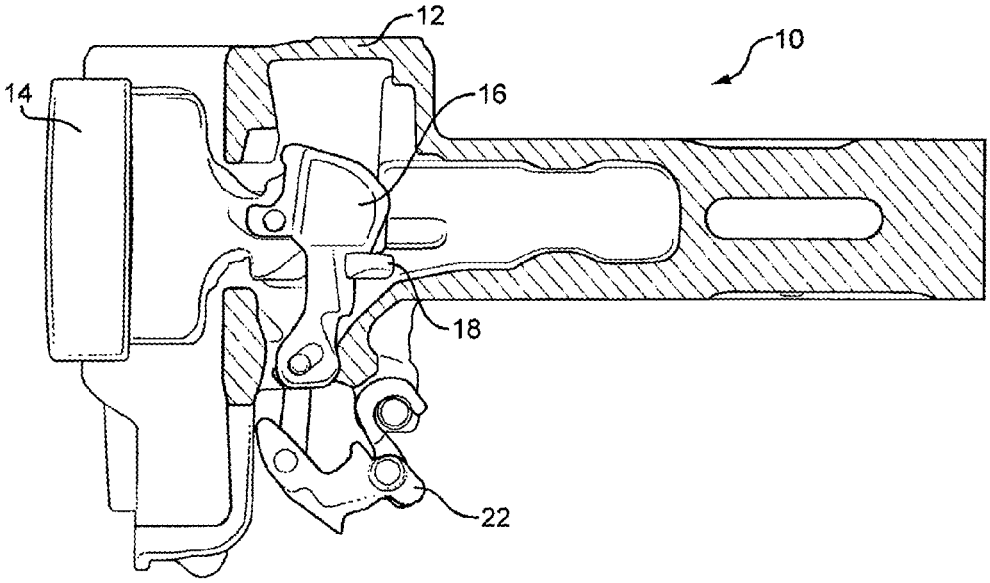
FIG. 3*a* is a cross-sectional view of the coupler of FIG. 1 in the locked position.
Figure 3B:
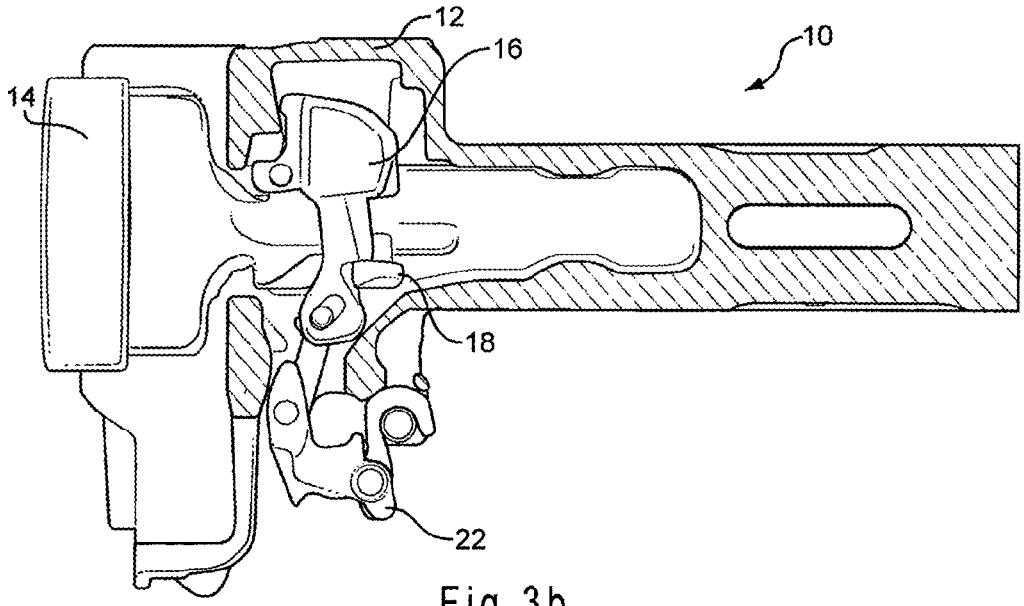
FIG. 3*b* is a cross-sectional view of the coupler of FIG. 1 in the lock-set position.
Figure 3C:
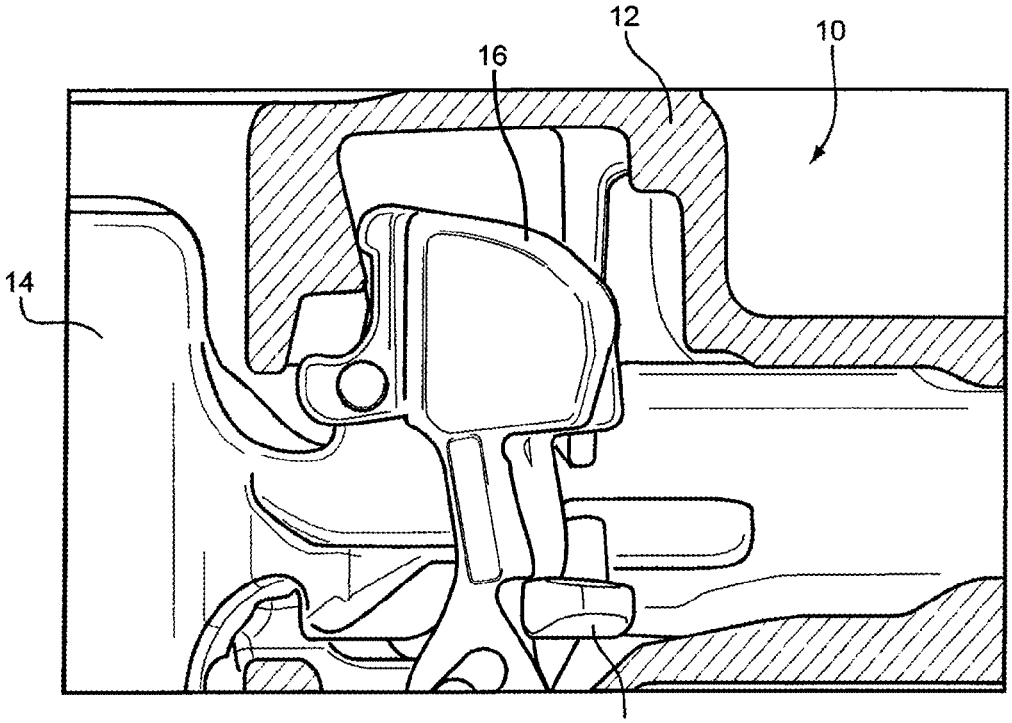
FIG. 3*c* is a close up cross-sectional view of the coupler of FIG. 1 in the lock-set position.
Figure 3D:
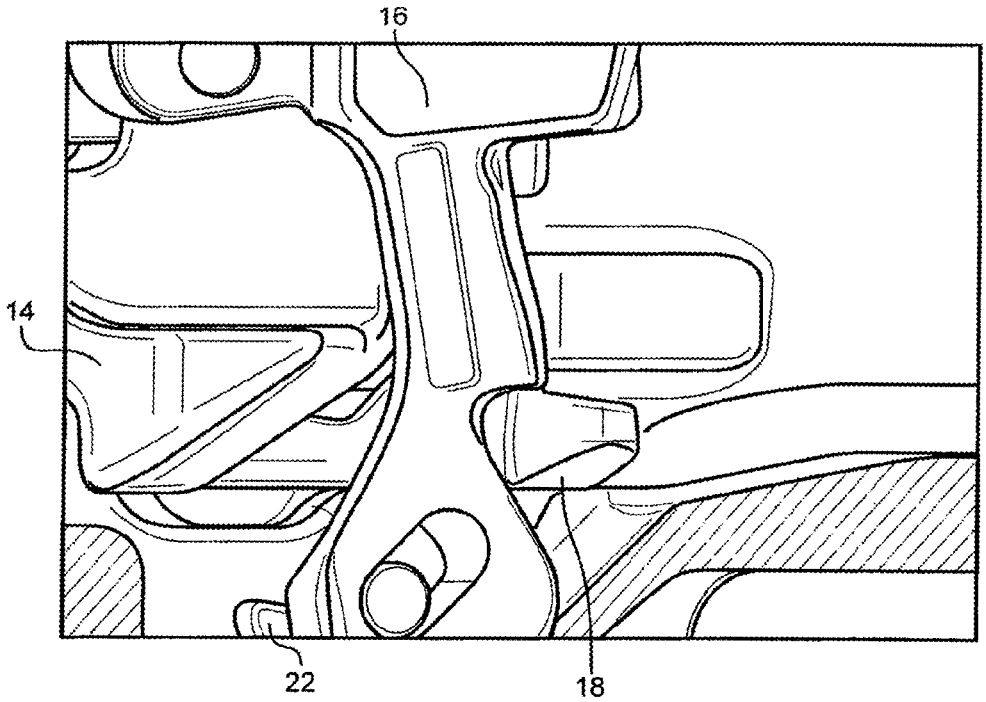
FIG. 3*d* is a close up cross-sectional view of the coupler of FIG. 1 in the lock-set position.
Figure 3E:
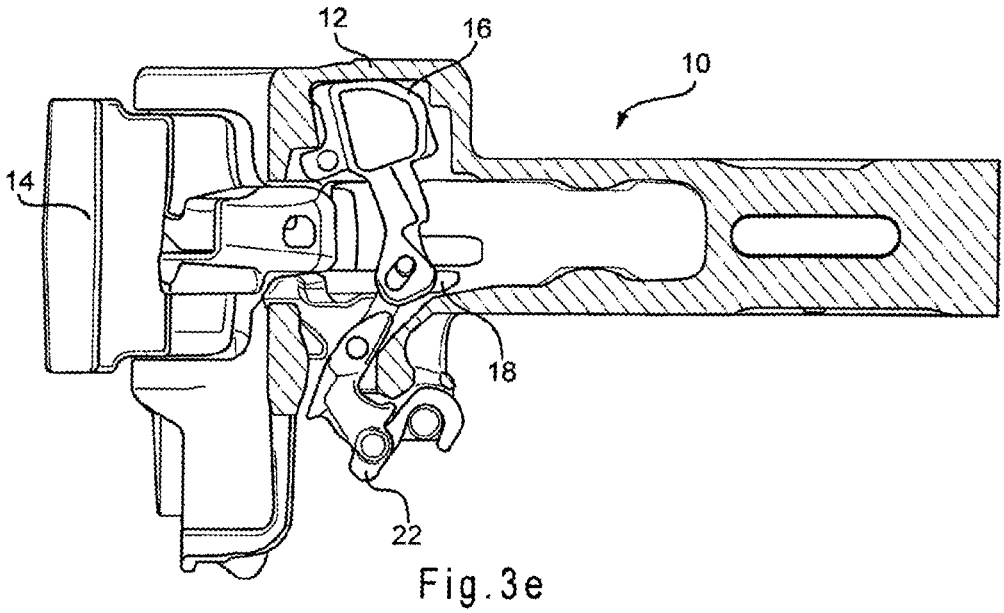
FIG. 3*e* is a cross-sectional view of the coupler of FIG. 1 in the unlocked position.

FIG. 1 shows an exploded coupler 10 in order to put the present invention in context. FIG. 2 shows the same coupler 10 in an assembled configuration. The body 12, knuckle 14, lock 16, thrower 18, pivot pin 20, and lock lift assembly 22 are shown. FIGS. 3*a*-3*e* illustrate the lock 16 in the "lock", "lock set" or "unlocked" configurations for reference. In FIG. 3*e*, the lock 16 is in the unlocked configuration. In FIGS. 3*b*, 3*c*, and 3*d*, the lock 16 is in the lock set position and in FIG. 3*a*, the lock 16 is in the locked position.

When two freight cars are coupled together (with the lock in its lowest position), it is not possible to throw the knuckle 14 to the open position. The lock set function allows a railroad employee, using the uncoupling lever (not shown) extending from the side of the car to the coupler 10, to raise the lock 16 without throwing the knuckle 14 to the open position. Once the lock 16 has been placed in the lock set position, it is then possible to pull one of the freight cars away from the other and have the knuckle 14 rotate to the open position absent of railroad employee intervention where the freight cars are being separated. However, if the lock 16 is not properly interfaced with the knuckle tail 24, rotation of the knuckle 14 to the open position may not occur and the advantage of the lock set function is not realized. The improvements to the lock surface and/or profile and/or contour that interfaces with the knuckle tail 24 are designed to ensure improved operation of the lock set function.

Figure 7:
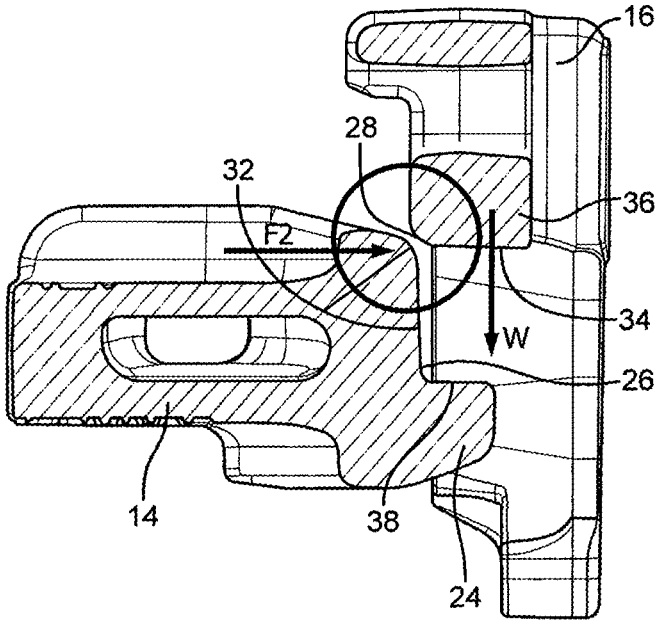
FIG. 7 is an alternate view of the interface between the lock and the knuckle.

When the lock 16 is raised to the lock set position, it is important that the area of contact between the lock 16 and knuckle tail 24 allows for the knuckle tail 24 to rotate under the lock 16 surface when a pull is applied at the pulling face 26 of the knuckle 14. If the area of contact between the lock 16 and knuckle tail 24 is such that the vertical component of the contact force raises the lock 16 slightly such that it cannot overcome the horizontal force resisting the knuckle 14 rotation, then the knuckle 14 will not rotate to the open position when a pulling force is applied at the pulling face 26 of the knuckle 14. The addition of a chamfer 28 on the knuckle shelf seat 34 as shown in FIGS. 5 and 7 ensures that these forces avoid the condition just mentioned and allow improved lock set operation.

The present disclosure considers the entire coupler system, rather than just the lock 16 and thrower 18. Through the use of Computer Aided Design (CAD) techniques each part is modeled and their operation is reviewed as a complete system. Previously, the interaction may have been prototyped, and then all the different permeations and different combinations of each variable were prototyped. This made the analysis of more than two features relative to each other very labor intensive, time consuming, and expensive to complete. Additionally, if the solution relied on one of the removable parts, when the part was removed from the body, the fix was also removed.

Physical interchange tests including couplers of various manufactures were conducted with specific application of the lock set function. Observations were made in those instances where the lock set function did not work properly or worked with marginal success. A critical factor in the proper lock set operation was found to be the area of contact 32 between the lock 16 and the knuckle tail 24. (FIGS. 6 and 7).

Figure 4:
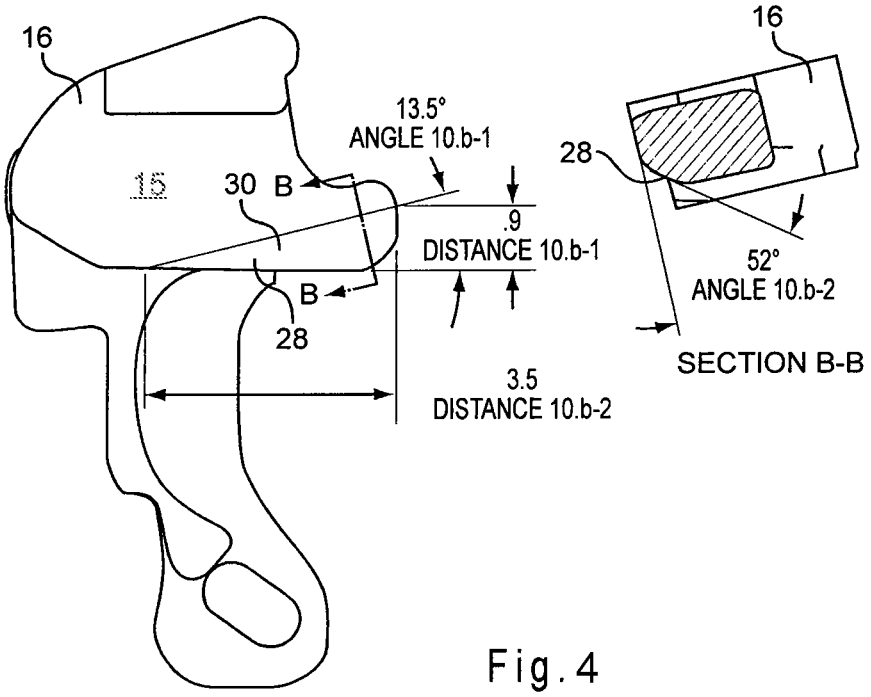
FIG. 4 is a side view of a lock in accordance with the present invention. Section B-B shows the chamfer of said lock.
Figure 5:
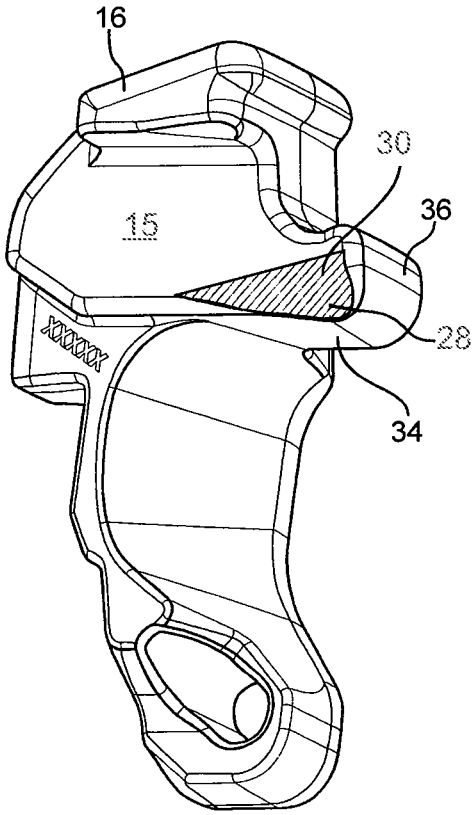
FIG. 5 is a perspective view of the lock of FIG. 4.

Referring to FIGS. 4 and 5, the present disclosure improves knuckle 14 rotation from lock set by adding a chamfer 28 on the knuckle shelf seat 34 of the lock 16 that extends up a locking face 15 of the lock 16 and engages area of contact 32. Preferably, the knuckle shelf seat chamfer 28 extends up to about 3.5" in length from a fulcrum face 36, but anywhere in a range from 2.5" to 3.5" is acceptable. As shown in FIG. 4, a lock 16 utilizing the chamfer 28 of the present disclosure illustrates the angle on the lock face due to the chamfer 28 length. This chamfer 28 creates an angled surface that reduces the force necessary to open the knuckle 14. A transitional area 30 may be included along a top portion of the chamfer 28. The disclosed chamfer 28 is also illustrated three-dimensionally in FIG. 5. The knuckle 14 and lock interface are shown in FIGS. 6 and 7.

Figure 6:
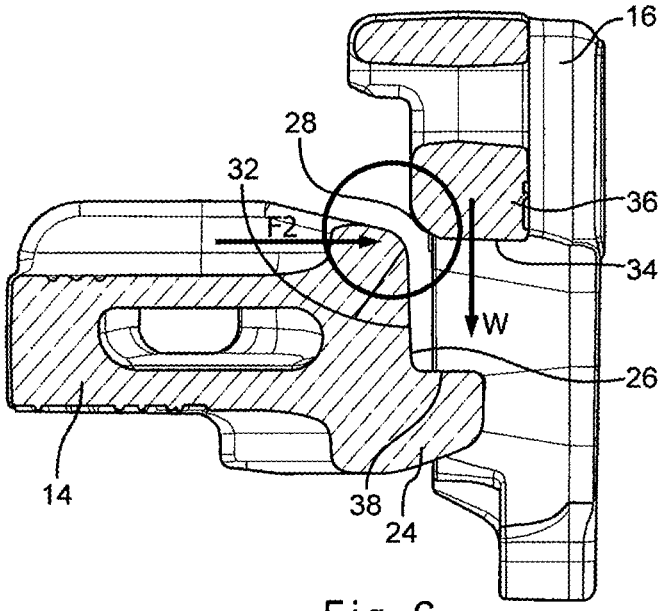
FIG. 6 is a view of the interface between the lock and the knuckle.
Figure 11:
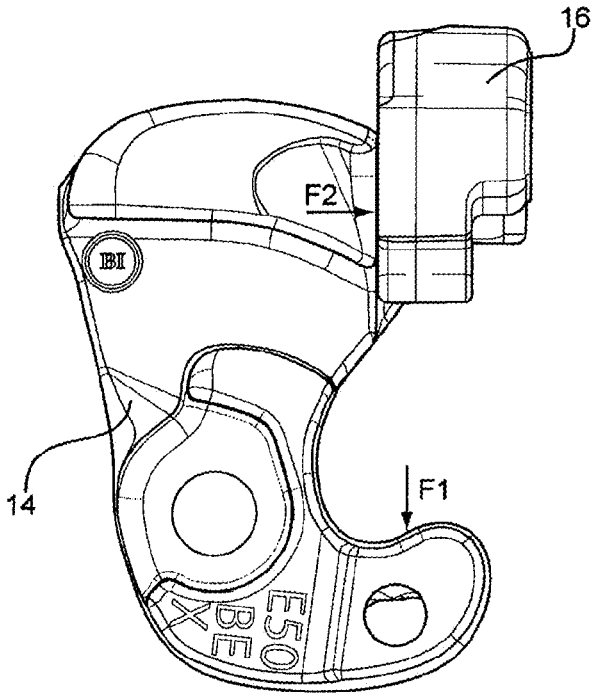
FIG. 11 is an alternate view of the interface between the lock and the knuckle.

FIG. 8 is a schematic view showing the circled area from FIGS. 6 and 7. FIG. 8 illustrates the vertical component of the contact force "W" and the horizontal force "F2" resisting the knuckle 14 rotation. FIG. 11 illustrates the forces in FIG. 8 from a different angle and includes pulling force, or draft force "F1" on the pulling face of the knuckle 14. The equation shown in FIG. 9 illustrates the reduction in force required to open the knuckle 14 due to the chamfer 28. If the angle Θ is 0°, there is the equivalent of excess overlap between the lock 16 and the knuckle 14 and requires infinite force, or can result in knuckle jamming. If the angle Θ is 90°, there is the equivalent of no excess overlap between the lock 16 and the knuckle 14 and the knuckle 14 requires little or no force to open.

Figure 10:
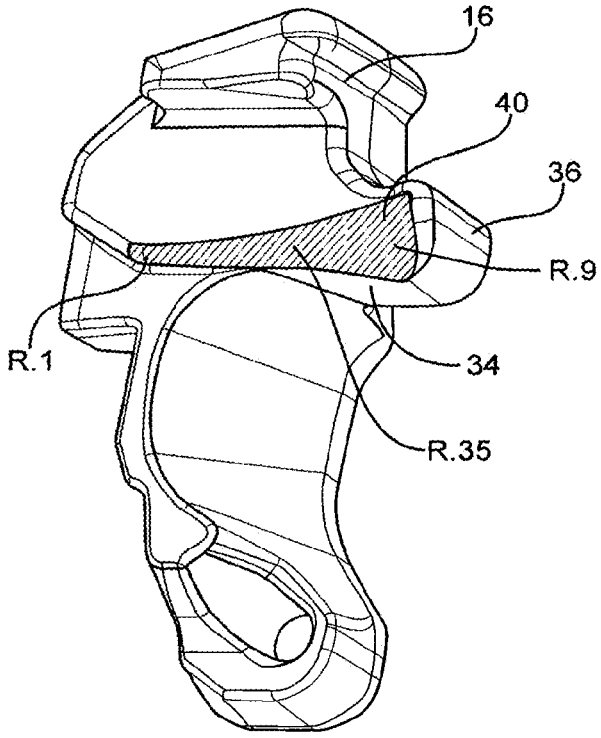
FIG. 10 is a perspective view of a lock including a variable radius fillet.

In an alternative embodiment of the present disclosure illustrated in FIG. 10, a variable radius fillet 40 is included on the knuckle shelf seat 34 rather than a chamfer 28 to accomplish the same effect. The variable radius fillet 40 illustrated in FIG. 10 begins at a radius of about 0.9" near the fulcrum face 36 of the lock 16, tapers to a radius of about 0.35" away from the fulcrum face 36 of the lock, and then tapers to a radius of about 0.1" at the end of the fillet farthest from the fulcrum face 36 of the lock 16. However, other radii are possible. As can be seen, the tapering to about 0.1" occurs where the variable radius fillet 40 is positioned over a thrower seat of the lock.

It should be noted that a wide range of changes could be made to the present embodiments without departing from the scope of the claimed invention. More or less material could be added to the designated areas. The areas could also vary as long as the material did not cause further interference with the rotation of the coupler knuckle or any other coupler components. Different profiles, and or shapes, and or combinations of chamfers—profiles—shapes in place of the compound chamfer could also be used.

It is therefore intended that the foregoing detailed description be regarded as illustrative rather than limiting, and that it be understood that it is the following claims, including all equivalents, that are intended to define the spirit and scope of this invention.

The invention claimed is:

1. An improved lock for a railroad coupler, said lock inserted between a body and a knuckle of said railroad coupler and interfaced with a lock lift assembly and a thrower in lock, lock set and unlocked configurations, said lock comprising:

a longitudinally tapered chamfer on a knuckle shelf seat starting at a fulcrum face of said lock and measured at least 2.5" in total length extended along a bottom edge of said knuckle shelf seat from said fulcrum face of said lock, the chamfer configured as a flat surface such as to facilitate movement of the chamfer against a knuckle tail of the knuckle between lock set and unlocked configurations.

2. The improved lock of claim 1, wherein the knuckle shelf seat chamfer is between at least 2.5" and about 3.5" in total length measured from said fulcrum face.

3. The improved lock of claim 1, wherein the chamfer on the knuckle shelf seat creates an angle relative to a locking face of said lock and relative to the knuckle shelf seat of said lock.

4. An improved lock for railroad coupler, said lock inserted between a body and a knuckle of the railroad coupler and interfaced with a lock lift assembly and a thrower in lock, lock set and unlocked configurations, said lock comprising:

a variable radius fillet located along a bottom edge of a knuckle shelf seat and at least partially along a lock face of said lock, the variable radius fillet having a radius that is largest at a point nearest to a fulcrum face and that tapers off to a smallest radius at a point farthest from said fulcrum face of said lock, the point of the smallest radius located above a thrower seat of the lock, such as to facilitate movement of the variable radius fillet against a knuckle tail of the knuckle between lock set and unlocked configurations; and wherein the radius at the point nearest to said fulcrum face of said lock comprises about 0.9", tapers to about 0.35" about half-way to the farthest point, and tapers to about 0.1" at the point farthest from said fulcrum face of said lock.

5. An improved lock for a railroad coupler, said lock inserted between a body and a knuckle of said railroad coupler and interfaced with a lock lift assembly and a thrower in lock, lock set and unlocked configurations, said lock comprising:

a chamfer of at least 2.5" in length on a bottom edge of a knuckle shelf seat, the chamfer defined at a first end as a wide-angled surface located underneath a fulcrum of said lock on a first side thereof and, on a second side thereof, located a substantial distance on a locking face away from a knuckle shelf seat of said lock; the chamfer defined at a second end by tapering to a narrow-angled surface with respect to the locking face along the knuckle shelf seat at a farthest point from the fulcrum, the chamfer configured as a flat surface such as to facilitate movement of the chamfer against a knuckle tail of the knuckle between lock set and unlocked configurations.

6. The improved lock of claim 5, where the chamfer measures between 2.5" and 3.5" in length along the knuckle shelf seat from the fulcrum.

7. The improved lock of claim 5, where the chamfer measures at least 2.5" in length along the knuckle shelf seat from the fulcrum.

* * * * *